US009445637B2

(12) United States Patent
Buczkowski et al.

(10) Patent No.: US 9,445,637 B2
(45) Date of Patent: Sep. 20, 2016

(54) APPAREL WITH POCKET

(75) Inventors: Bradley T. Buczkowski, Simpsonville, SC (US); Andrew J. Lehman, Simpsonville, SC (US); William O. Lollis, Greenville, SC (US)

(73) Assignee: Huzu, LLC, Columbia, SC (US)

( * ) Notice: Subject to any disclaimer, the term of this patent is extended or adjusted under 35 U.S.C. 154(b) by 1354 days.

(21) Appl. No.: 13/016,605

(22) Filed: Jan. 28, 2011

(65) Prior Publication Data

US 2011/0185471 A1 Aug. 4, 2011

Related U.S. Application Data

(60) Provisional application No. 61/299,593, filed on Jan. 29, 2010.

(51) Int. Cl.

| | |
|---|---|
| ***A41D 1/00*** | (2006.01) |
| ***A41D 3/02*** | (2006.01) |
| ***A41D 27/20*** | (2006.01) |
| ***A41D 3/00*** | (2006.01) |

(52) U.S. Cl.

CPC ..... *A41D 27/20* (2013.01); *A41D 3/00* (2013.01); *A41D 27/201* (2013.01)

(58) Field of Classification Search

CPC .. A41D 27/20; A41D 27/201; A41D 27/205; A41D 3/00; A41D 3/005; A41D 13/012; A41D 1/04; A41D 2400/48; A01K 1/029; A47D 13/02; A47D 13/08

USPC ..... 2/1, 84, 85, 90, 93, 94, 96, 108, 247, 2/248, 250, 253; 224/191, 576, 587

See application file for complete search history.

(56) References Cited

U.S. PATENT DOCUMENTS

| | | | | |
|---|---|---|---|---|
| 1,551,059 | A | | 8/1925 | Schnellbacher |
| 1,764,483 | A | * | 6/1930 | Watkins ..... 2/247 |
| 1,879,341 | A | | 9/1932 | Lapham |
| 2,058,801 | A | | 10/1936 | Kamil |
| 2,102,251 | A | | 12/1937 | Arst |
| D161,540 | S | * | 1/1951 | Russfield ..... D2/836 |
| 2,642,576 | A | * | 6/1953 | Kotkes ..... 2/253 |
| 2,846,685 | A | * | 8/1958 | Ehrich ..... 2/51 |
| 3,602,914 | A | | 9/1971 | Castello |
| 4,062,064 | A | | 12/1977 | Vosatka |
| 4,404,687 | A | * | 9/1983 | Hager ..... 2/94 |
| 4,464,798 | A | * | 8/1984 | Livingstone ..... 2/247 |
| 4,476,587 | A | | 10/1984 | Itoi |
| 4,502,155 | A | * | 3/1985 | Itoi ..... 2/115 |

(Continued)

OTHER PUBLICATIONS

Declarations of David M. Claeys and Andrew Claeys in U.S. Pat. No. 8,756,717.

(Continued)

*Primary Examiner* — Anna Kinsaul
*Assistant Examiner* — Jameson Collier
(74) *Attorney, Agent, or Firm* — Nelson Mullins Riley & Scarborough, LLP

(57) ABSTRACT

An article of apparel is disclosed. In one embodiment, an article of apparel includes a front panel, a pouch attached to the front panel, a pocket disposed between the pouch and the front panel, and a closure that allows a first end of the pocket to be selectively opened and closed. The pocket includes a second end opposite the first end and a body joining the first and second ends. The pocket is attached to the pouch and the front panel.

29 Claims, 5 Drawing Sheets

(56) References Cited

U.S. PATENT DOCUMENTS

| | | | | |
|---|---|---|---|---|
| 4,573,218 | A | 3/1986 | Saggs | |
| 4,630,319 | A | 12/1986 | Mathis | |
| 4,791,681 | A | 12/1988 | Dean | |
| 4,825,471 | A | 5/1989 | Jennings | |
| D315,632 | S | 3/1991 | Boyle | |
| 5,119,510 | A * | 6/1992 | Schilling | 2/4 |
| 5,165,115 | A * | 11/1992 | Stanislaw | 2/247 |
| 5,222,259 | A | 6/1993 | Bristor | |
| 5,255,392 | A * | 10/1993 | Stanislaw | 2/247 |
| 5,517,696 | A * | 5/1996 | Krugler | 2/250 |
| 5,642,526 | A | 7/1997 | Thompson | |
| 5,683,019 | A * | 11/1997 | Schaber | 224/191 |
| 5,794,263 | A | 8/1998 | Carman | |
| 5,884,338 | A * | 3/1999 | Golde | 2/247 |
| 6,175,960 | B1 | 1/2001 | Knittel | |
| D439,029 | S | 3/2001 | Goldman | |
| 6,477,710 | B1 | 11/2002 | Ojoyeyi | |
| 6,760,922 | B1 * | 7/2004 | Morales | 2/94 |
| 6,772,440 | B1 | 8/2004 | Foster | |
| 6,839,911 | B1 | 1/2005 | Mathews | |
| 6,848,118 | B2 | 2/2005 | Barnes et al. | |
| 6,976,273 | B1 * | 12/2005 | Lewis et al. | 2/94 |
| 7,051,373 | B1 | 5/2006 | Krall | |
| D526,764 | S | 8/2006 | Toomey et al. | |
| 7,143,450 | B2 | 12/2006 | Green, III | |
| D535,456 | S | 1/2007 | Anderson | |
| D551,429 | S | 9/2007 | Wager | |
| 7,296,303 | B1 | 11/2007 | Samet | |
| 7,364,491 | B2 * | 4/2008 | Updyke | 450/89 |
| D570,577 | S | 6/2008 | Keppler | |
| 7,418,740 | B2 * | 9/2008 | Anderson et al. | 2/69 |
| D584,482 | S | 1/2009 | Marsh | |
| 7,543,338 | B2 | 6/2009 | Culhane | |
| D600,887 | S | 9/2009 | Williams et al. | |
| 7,620,998 | B2 | 11/2009 | Sandoval | |
| 7,636,949 | B1 * | 12/2009 | Shooshan | 2/48 |
| D608,079 | S | 1/2010 | Boyle et al. | |
| D608,983 | S * | 2/2010 | Myers | D2/857 |
| 7,684,755 | B2 | 3/2010 | Pierce et al. | |
| 7,712,645 | B2 * | 5/2010 | Calkin | 224/649 |
| D627,540 | S | 11/2010 | Claeys | |
| 8,087,095 | B2 * | 1/2012 | Maier | 2/102 |
| 8,312,568 | B2 * | 11/2012 | Marois et al. | 2/252 |
| 8,566,963 | B2 * | 10/2013 | Ryan | 2/84 |
| 8,756,717 | B2 | 6/2014 | Claeys | |
| 2008/0196140 | A1 * | 8/2008 | Mayerson et al. | 2/84 |
| 2012/0005802 | A1 * | 1/2012 | Claeys | 2/84 |
| 2012/0304357 | A1 * | 12/2012 | Highfield | 2/69 |
| 2013/0152270 | A1 * | 6/2013 | Neal et al. | 2/84 |
| 2014/0245518 | A1 | 9/2014 | Claeys | |
| 2016/0106166 | A1 * | 4/2016 | Buczkowski | A41D 3/00 2/253 |

OTHER PUBLICATIONS

Supplement to Information Disclosure Statement dated Jul. 12, 2016.

* cited by examiner

APPAREL WITH POCKET

RELATED APPLICATION AND CLAIM FOR PRIORITY

This application claims priority to U.S. Provisional Patent Application No. 61/299,593, entitled, "Apparel With Integrated Pocket," filed Jan. 29, 2010, the priority benefit of which is claimed by this application and which is incorporated in its entirety herein by reference.

FIELD OF THE INVENTION

The present invention relates generally to apparel. More particularly, the present invention relates to an article of apparel with a pocket.

BACKGROUND

Apparel satisfies many various requirements. Apparel may be functional. For example, apparel provides warmth and protection from the elements. Apparel may also be aesthetically pleasing to the wearer as well as to those who come in contact with the wearer. In addition, apparel may serve to convey a message or advertisement or outwardly demonstrate association or affiliation with a cause or an organization, such as for example, a university or a professional athletic team.

Pockets are, of course, known. Generally, the purpose and placement of pockets tend to be incidental to that of the apparel in which the pocket is placed or sewn. Moreover, when a typical pocket is used for a specific purpose, such as for example, the storage or placement of a beverage, known pockets can be unsatisfactory. For example, pockets may not be of the proper size to accommodate an item—in this example, a beverage container—to be placed in the pocket. Pockets may not provide proper or adequate thermal insulation of the beverage inside the beverage container or a barrier to moisture or condensation from the container. Improper positioning of a pocket may contribute to spilling the beverage inside the beverage container.

Additionally, when a beverage container is placed inside the pocket, the beverage container may obscure a logo or design displayed on the article of apparel. Furthermore, a pocket may be obtrusive or detract from the overall appearance of the article of apparel.

SUMMARY

The present invention recognizes and addresses disadvantages of prior art constructions and methods. Embodiments of the present invention provide an article of apparel with a pocket. In one aspect, the present invention provides an article of apparel comprising a front panel, a pouch attached to the front panel, and a pocket adjacent to the front panel and disposed within an interior area of the pouch. The interior area of the pouch can be defined by an interior surface of the pouch and the front panel. The pocket can comprise a first end, a closed end opposite the first end, and a body joining the first end and the closed end. In one embodiment, a first side of the first end of the pocket can be attached to the front panel and a second side of the first end of the pocket can be attached to the pouch proximate to an uppermost edge of the pouch. The first and second sides of the first end of the pocket can be removably attached to one another.

In another aspect, the present invention provides an article of apparel comprising a front panel, a pouch attached to the front panel, a pocket disposed between the pouch and the front panel, and means for selectively opening and closing a first end of the pocket. The pocket comprises a second end opposite the first end and a body joining the first and second ends. The first end of the pocket can be attached to the pouch and the front panel.

In yet another aspect, the present invention provides a method of making an article of apparel comprising a front panel, a pouch attached to the front panel, and a pocket disposed between the pouch and the front panel. The method comprises attaching a first side of a first end of the pocket to the front panel and attaching a second side of the first end of the pocket to an uppermost edge of the pouch. The first and second sides of the first end of the pocket are disposed in facing opposition to one another.

The method can comprise positioning the pocket within an interior area of the pouch. The interior area of the pouch can be defined by an interior surface of the pouch and the front panel. The method can comprise removing a portion of the pouch from the front panel and aligning the first end of the pocket with the uppermost edge of the pouch.

In still another aspect, the present invention provides a method of making an article of apparel comprising a panel comprising an interior surface and an exterior surface. The method comprises forming a seam in the panel, aligning a first end of the pocket with the seam, and attaching a first end of the pocket to the interior surface of the panel. The pocket may comprise a closed end opposite the first end and a body joining the first and the closed end. The body of the pocket may be disposed adjacent to the interior surface of the panel. In one embodiment, the method may comprise attaching the first end of the pocket below the seam.

Those skilled in the art will appreciate the scope of the present invention and realize additional aspects thereof after reading the following detailed description of the preferred embodiments in association with the accompanying drawing figures.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
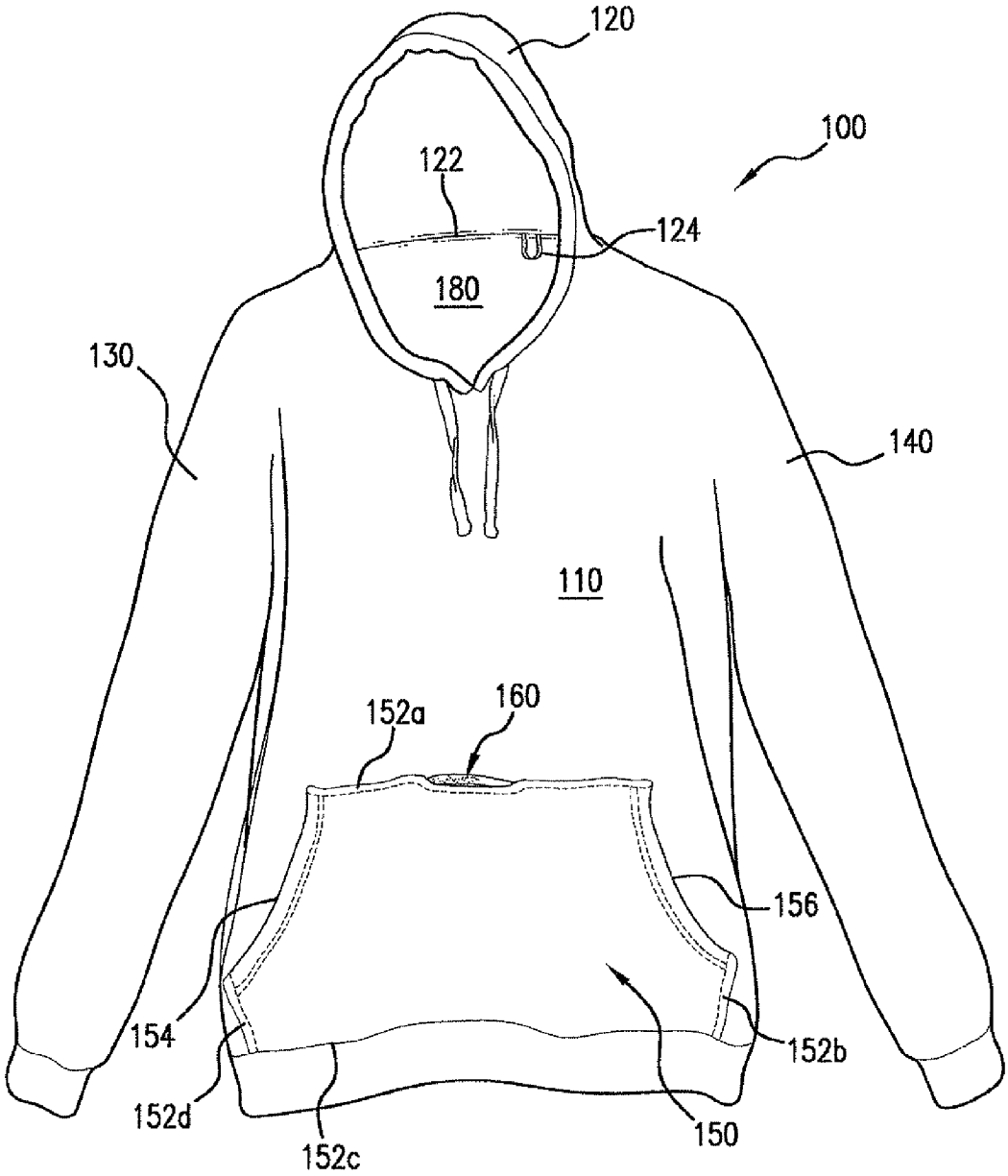
FIG. 1 is a front view of an article of apparel with an embodiment of a pocket in accordance with the present invention.

Repeat use of reference characters in the present specification and drawings is intended to represent same or analogous figures or elements of the invention.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Referring now to FIG. 1, a preferred embodiment of an article of apparel 100 in accordance with the present invention is shown. The article of apparel 100 shown is commonly referred to as a sweatshirt, and will be referred to hereinafter as such. Other suitable articles of apparel can be used, however, such as for example, tee-shirts, casual or dress shirts, jackets, sport coats, suit coats, blazers, trench coats, overcoats, windbreakers, parkas, aprons, ponchos, and water shirts. The article of apparel has a vertical longitudinal axis that bisects the article of apparel into a left half portion and a right half portion.

As shown, the sweatshirt 100 includes a front panel 110 and a back panel 180.

The back panel 180 is disposed opposite the front panel 110, and the front panel 110 and the back panel 180 can be joined together by panel seams (not shown). Alternatively, the sweatshirt 100 can be formed of a single or unitary piece of material in which the term front panel refers to the front side of the sweatshirt 100. A decorative logo or design (not shown) can be sewn onto, or otherwise affixed or adhered to, the front panel 110. The sweatshirt 100 can include a hood 120. In an alternate embodiment, the sweatshirt 100 can be hoodless. As shown, the hood 120 is pulled over.

The hood 120 can be joined or attached to the front panel 110 and the back panel 180 of the sweatshirt 100 by hood seam 122. In one embodiment, a loop 124 can be coupled with the hood 120. The loop 124 can be fixedly attached to the hood seam 122. The loop 124 can be sewn or adhered to or proximate to the hood seam 122. Alternatively, the loop 124 can be removably attached to or proximate to the hood seam 122 by, for example, buttons or snaps. The loop 124 can be adapted or configured to retain or secure earphones or other devices, such as electrical cords, cables, wires, or flexible drinking tubes or straws. The loop 124 can be placed in other suitable locations within or proximate to the hood 120 in which the loop 124 is generally inconspicuous, does not interfere with the intended use of the sweatshirt 100, and is not uncomfortable, distracting, or otherwise annoying to an individual wearing the sweatshirt 100. The loop 124 can be formed of fabric or other suitable materials, and can further include snaps, buttons, or drawstrings.

A first sleeve 130 and a second sleeve 140 depend from the front panel 110 and the back panel 180. The first sleeve 130 can be joined with the front panel 110 and the back panel 180 by first sleeve seams (not shown). The second sleeve 140 can be joined with the front panel 110 and the back panel 180 by second sleeve seams (not shown). In an alternate embodiment, the sweatshirt 100 can be short-sleeved. In another embodiment, the sweatshirt 100 can be sleeveless.

Attached to the front panel 110 of the sweatshirt 100 is a pouch 150. The pouch 150 is attached to the front panel 110. The pouch 150 can be attached to an exterior surface of the front panel 110 by a plurality of pouch seams 152*a-d*. Alternatively, the pouch 150 can be adhered to the front panel 110. The pouch 150 includes a lateral first opening 154 and a lateral second opening 156. The first opening 154 and the second opening 156 are disposed on opposing ends of the pouch 150. The first lateral opening 154 is located entirely within a left half portion of the sweatshirt and the second lateral opening 156 is located entirely within a right half portion of the sweatshirt. The first opening 154 provides sufficient room for a portion of the first sleeve 130 and a wearer's hand (not shown) to rest in or retrieve items from the pouch 150. Likewise, the second opening 156 provides sufficient room for a portion of the second sleeve 140 and a wearer's other hand (not shown) to rest in or retrieve items from the pouch 150. The pouch 150 is sufficiently sized and adapted to conveniently store and carry items. In alternative embodiments, the term pouch can refer to a pocket, a different or additional panel of fabric or clothing, or an exterior or interior portion of a panel of a garment or article of apparel.

Figure 2:
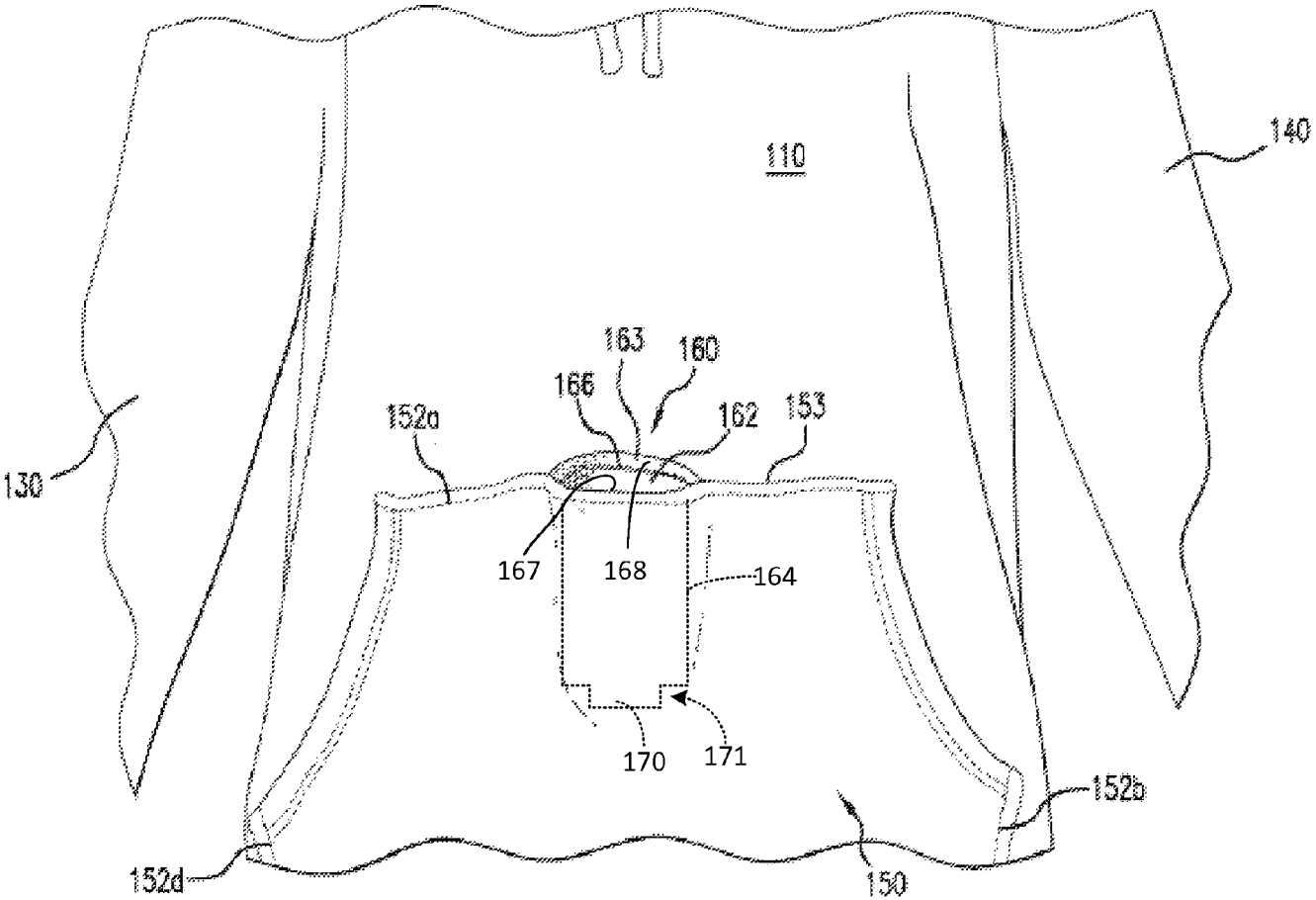
FIG. 2 is an enlarged view of the pocket shown in FIG. 1.

As best shown in FIG. 2, a pocket 160 is disposed within the pouch 150 and adjacent to the front panel 110 of the sweatshirt 100. The pocket 160 includes an upper first end 162 and a lower second end (not shown) disposed opposite the first end 162. The first end 162 of the pocket 160 may be open or closed. The second end can be closed partially or completely, and will be referred to hereinafter as the closed end. Disposed between and joining the first end 162 and the closed end is a body 164 (see FIG. 5).

The first end 162 includes a first side 163 and a second side (indicated at 167) in facing opposition to the first side 163. The first end 162 is adapted to receive or accept an item to be placed in the pocket 160, such as those items described below. The closed end 170 of the pocket 160 is adapted to support the item placed in the pocket 160. There may be a gap 171 between the closed end of the pocket 160 and the body 164, such that the closed end is substantially closed yet sufficient to permit the pocket 160 to collapse when there is no item in the pocket 160. In another embodiment, there may be no obvious gap between the closed end of the pocket 160 and the body 164 in order to retain smaller items within the pocket 160. In yet another embodiment, there may be a hole or orifice formed in the closed end of the pocket 160, which may facilitate the removal of an item from the pocket 160. The hole or orifice may also facilitate the routing of a cable, cord, or drinking straw from the pocket 160.

When the first side 163 and the second side of the first end 162 of the pocket 160 are coupled or joined together, the first end 162 of the pocket 160 is in a closed position. The body 164 of the pocket 160 is generally flat when the pocket 160 is in the closed position. The pocket 160 is thus further concealed and unobtrusive, and therefore, does not detract from the appearance of the sweatshirt 100. When the first side 163 and the second side of the first end 162 of the pocket 160 are apart, the first end 162 of the pocket 160 is in an open position. The wearer of the sweatshirt 100 can insert an item into the pocket 160 when the first end 162 of the pocket 160 is in the open position.

Figure 3:
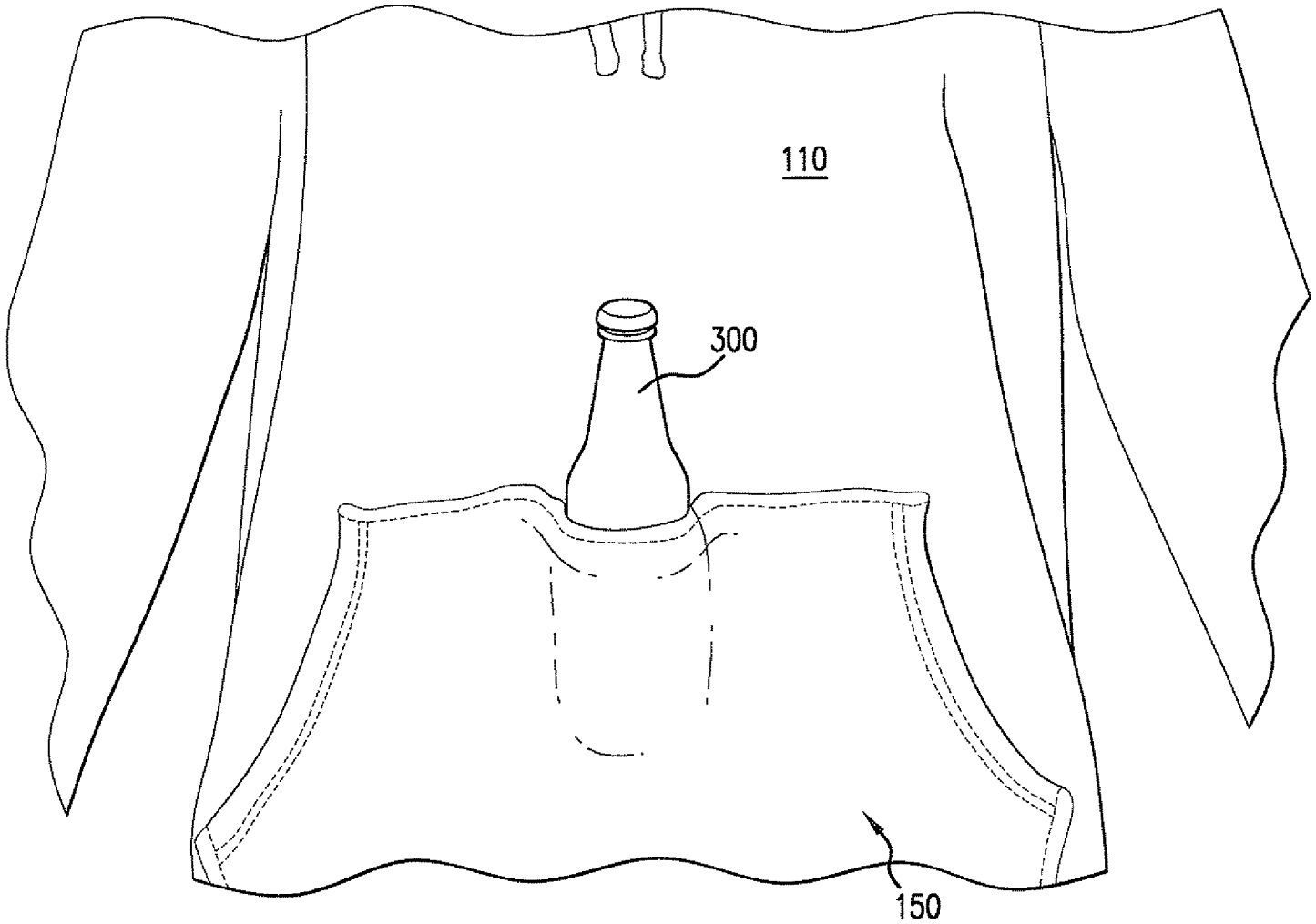
FIG. 3 is an enlarged view of the pocket shown in FIG. 1 with a beverage container in the pocket.
Figure 4:
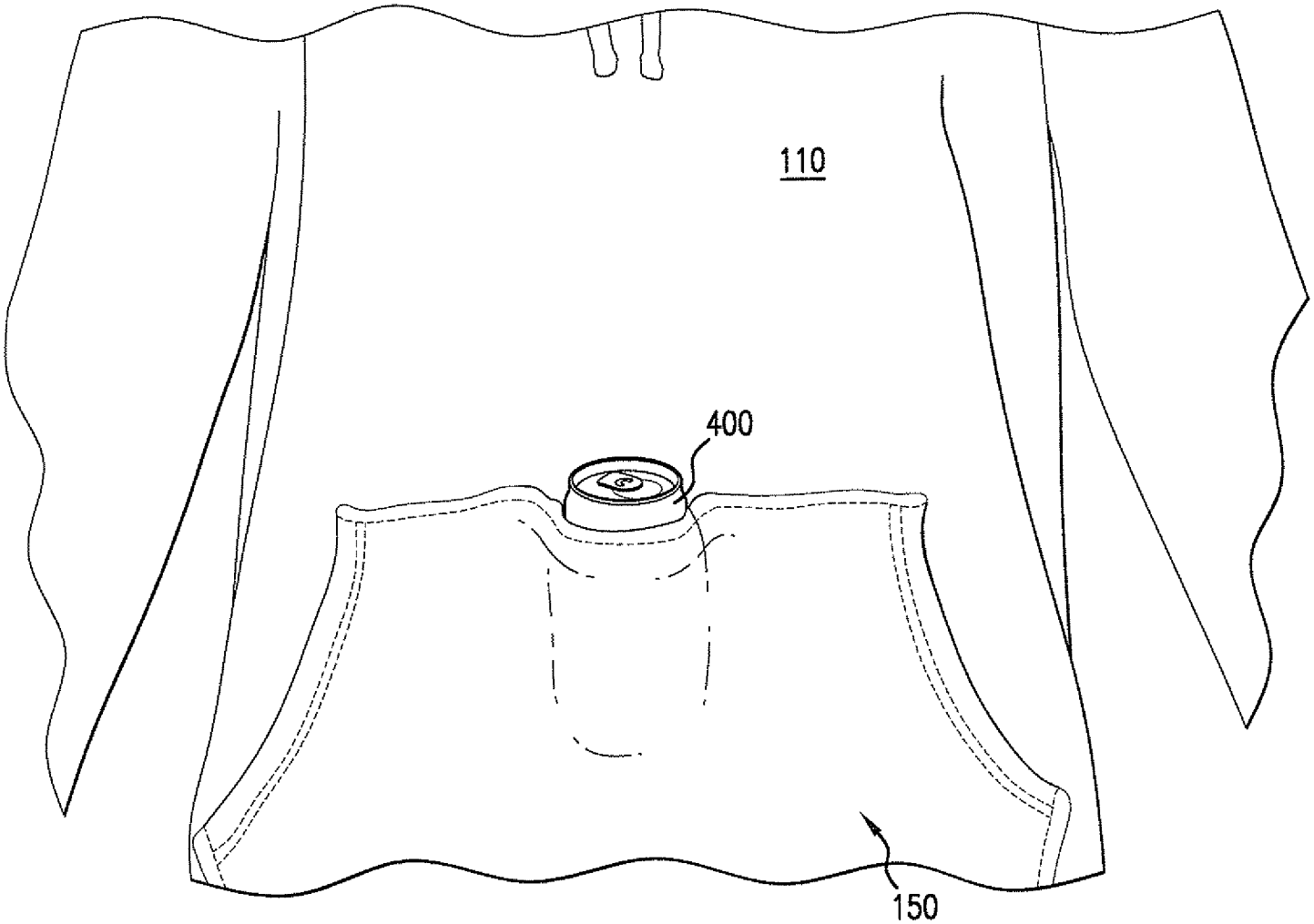
FIG. 4 is an enlarged view of the pocket shown in FIG. 1 with another beverage container in the pocket.

The pocket 160 can be adapted to support a beverage container such as a bottle 300 (shown in FIGS. 3 and 5) or a can 400 (shown in FIG. 4). In other embodiments, the pocket 160 can be adapted to accommodate other items, such as for example, portable electronic devices including smartphones, personal digital assistants and hand-held video games, cosmetics, books, calendars, passports, wallets, hunting or sporting equipment and gear, and the like. The size and configuration of the pocket can vary depending on the particular characteristics of the item to be placed in the pocket 160.

The pocket 160 can be made of a flexible, thermally-insulating material, such as for example, neoprene, foam (including closed-cell foam), or fabric. The pocket 160 material may also act as a moisture barrier keeping the sweatshirt 100 and the user dry. In one embodiment, the pocket 160 may be a commercially available bottle or can holder, commonly referred to as a koozie, coosie, hugger, huggie, can cooler, or sleeve. Other suitable materials can be used for the pocket 160. Where the pocket 160 is intended to protect electronic equipment, a more rigid material may be used. In another embodiment, a water-proof container or pocket liner can be used.

The pocket 160 is attached to or integrated with the sweatshirt 100 by a pocket seam 166 that attaches the first side 163 of the first end 162 of the pocket 160 to the front panel 110 of the sweatshirt 100 while the second side of the first end 162 of the pocket 160 is attached to the pouch 150 by the pouch seam 152*a*. The pocket seam 166 and the pouch seam 152*a* are different seams. The pocket 160 may be fixedly attached to the sweatshirt 100 using other suitable alternatives. For example, the pocket 160 may be adhered to the front panel 110 and the pouch 150. Alternatively, the pocket 160 can be releasably attached to the sweatshirt 100 by, for example, snaps, hooks, zippers or buttons, in which case the pocket 160 may be interchangeable or removable with the sweatshirt 100. In another embodiment, a flexible or semi-rigid frame that is adapted to accept a reusable or disposable pocket or liner may be secured or affixed to the front panel 110 and the pouch 150.

The pocket 160 resides within an interior area 158 (see FIG. 5) of the pouch 150, and is therefore accessible by the wearer's hands from the first opening 154 or the second opening 156. The interior area 158 of the pouch 150 is defined by an interior surface (not shown) of the pouch 150 and the front panel 110. The placement and positioning of the pocket 160 coincides generally with the natural position in which an individual typically holds a beverage, i.e., front and center and toward the mid-section. By disposing the pocket 160 within the interior area 158 of the pouch 150 and aligning the first side 163 and the second side of the first end 162 of the pocket 160 with or proximate to the pouch seam 152*a*, the pocket 160 can be concealed and unobtrusive.

The first end 162 of the pocket 160 can be aligned with the pouch seam 152*a*. The pouch seam 152*a* and the pocket seam 166 are substantially aligned with one another when the first end 162 of the pocket 160 is in a closed position, that is, when the first side 163 and the second side of the first end 162 of the pocket 160 are coupled together. When the pocket 160 is closed in this aligned configuration, the first side 163 and the second side of the first end 162 of the pocket 160 are substantially aligned with the uppermost edge 153 of the pouch 150. In another embodiment, the first side 163 and the second side of the first end 162 of the pocket 160 can be disposed below the uppermost edge 153 of the pouch 150 or the pouch seam 152*a* such that the pocket 160 is further concealed in the closed position.

The first end 162 of the pocket 160 can thus be placed such that the pocket 160 does not detract from the appearance of the sweatshirt 100. Moreover, this placement of the pocket 160 provides additional space on the front panel 110 of the sweatshirt 100 for placement of logos and designs. Alternatively, the pocket 160 may be placed in one or more other suitable locations in the sweatshirt 100, such as for example, in a breast-pocket (not shown). Additionally, the pocket 160 may be placed in other suitable positions within the pouch 150, such as for example, off-center (not shown). An off-center placement of the pocket 160 may permit the placement of a plurality of pockets (not shown), such as proximate to the first opening 154 and the second opening 156 of the pouch 150. Off-center placement of the pocket 160 also may be advantageous where the garment is zippered (not shown). Furthermore, the pocket 160 may be placed in a hip-holster position (not shown), or a dual-hip-holster arrangement (not shown).

In one embodiment, the first side 163 and the opposite second side of the first end 162 of the pocket 160 can include means for selectively opening and closing the first end 162 of the pocket 160. Opening and closing means can be used to removably attach the first side 163 and the second side of the first end 162 of the pocket 160 and can include a reclosable fastener 168, such as hook and loop fasteners commercially available from VELCRO® or 3M™ such that the first end 162 of the pocket 160 can be opened and closed selectively and repeatedly. Other suitable reclosable fasteners can be attached to the first side 163 and the second side and can include snaps, buttons, zippers, drawstrings, and elastic bands.

Figure 5:
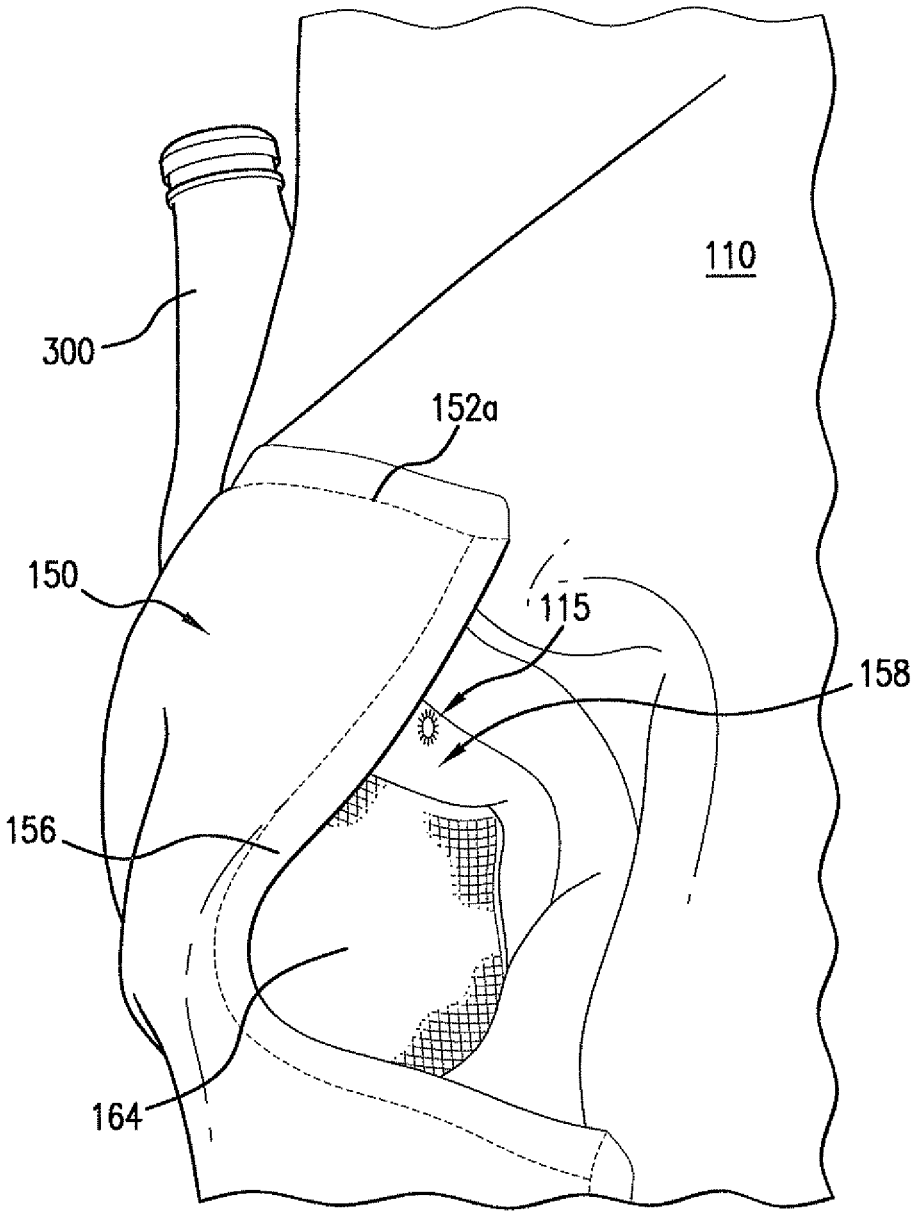
FIG. 5 is a side view of the pocket with the beverage container shown in FIG. 3.

In one embodiment, the front panel 110 can include an eyelet 115 formed or sewn into the front panel 110. An eyelet is a small hole for a cord or tube to be passed through. Although not shown, a cord, wire, cable or flexible drinking straw or tube can be routed from the pocket 160, through the eyelet 115, underneath the front panel 110, up to the hood 120, and secured to the loop 124. The eyelet 115 may include stitching or may be surrounded by a small metal ring for reinforcement and to prevent tears in the fabric surrounding the eyelet 115. Where concealment or unobtrusiveness is desired, the eyelet 115 can be placed behind the pouch 150. As shown in FIG. 5, the eyelet can be positioned proximate to the pocket 160 and proximate to the second opening 156 of the pouch 150. The eyelet 115 can be positioned in other areas of the sweatshirt 100.

The pocket 160 can be incorporated into the sweatshirt 100 when the sweatshirt 100 is being sewn or afterwards. The pocket 160 can be incorporated into the sweatshirt 100 by sewing the pocket seam 166 into the first side 163 of the first end 162 of the pocket 160 and the front panel 110. The second side of the first end 162 of the pocket 160 is sewn into the pouch 150 with pouch seam 152*a*. If the sweatshirt 100 has been sewn prior to incorporating the pocket 160, a portion of the pouch seam 152*a* must be removed from the front panel 110. The pocket 160 is positioned within the interior area 158 of the pouch 150. The first end 162 of the pocket 160 is aligned or placed slightly below the uppermost edge 153 of the pouch 150. The pocket 160 is attached to the sweatshirt 100 by sewing the first side 163 of the first end 162 of the pocket 160 to the front panel 110 with the pocket seam 166 and sewing the second side of the first end 162 of the pocket 160 proximate to the uppermost edge 153 of the pouch 150 along the portion of the pouch seam 152*a* that was removed. As described above, other suitable methods can be used to integrate the pocket 150 with the sweatshirt 100.

A method of making an article of apparel with a pocket, such as the pocket 160 described above, may include forming a seam in a panel. In one embodiment a slit can be cut into the panel. A first end of the pocket may be aligned with the seam or the slit. The first end of the pocket can be attached to an interior surface of the panel. In another embodiment, the first end of the pocket can be attached to an exterior surface of the panel. The first end of the pocket can be attached below the seam or the slit. The body of the pocket can be disposed adjacent to the interior surface of the panel. Alternatively, the pocket can be disposed adjacent to the exterior surface of the panel. In one embodiment the body of the pocket can be juxtaposed with the interior surface of the panel. In another embodiment, the body of the pocket can be juxtaposed with the exterior surface of the panel.

While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments as modifications can be made. Therefore, it is contemplated that any and all such embodiments are included in the present invention as may fall within the scope and spirit thereof.

What is claimed is:

1. An article of apparel having a vertical longitudinal axis that bisects the article of appeal into a left half portion and a right half portion, said article of apparel comprising:

a front panel;

a pouch defined by pouch panel attached to an exterior surface of the front panel, an interior surface of the pouch panel and the exterior surface of the front panel defining an interior area of the pouch, wherein the pouch is closed along a bottom of the pouch and defines a first lateral opening and a second lateral opening opposite the first lateral opening so that said interior area of the pouch is accessible through both the first lateral opening and the second lateral opening to allow insertion of a wearer's hands, wherein the first lateral opening is located entirely within the left half portion and the second lateral opening is located entirely within the right half portion; and a pocket comprising an upper first end, a lower closed end opposite the first end, and a body joining the first end and the closed end, the pocket adjacent to the front panel and disposed within the interior area of the pouch, wherein a first side of the first end of the pocket is attached to the front panel and a second side of the first end of the pocket is attached to the pouch panel proximate to an uppermost edge of the pouch panel, and wherein the first and second sides of the first end of the pocket are removably attached to one another, and wherein the body of the pocket is accessible from both the first and second lateral openings.

2. The article of apparel of claim 1, wherein the second side of the first end of the pocket is disposed in facing opposition to the first side of the first end of the pocket.

3. The article of apparel of claim 1, wherein the first and second sides of the first end of the pocket comprise a reclosable fastener.

4. The article of apparel of claim 3, wherein the reclosable fastener comprises a hook and loop fastener.

5. The article of apparel of claim 1, wherein the first side of the first end of the pocket is fixedly attached to the front panel by a pocket seam and the second side of the first end of the pocket is fixedly attached to the pouch panel by a pouch seam.

6. The article of apparel of claim 5, wherein the pouch seam is substantially aligned with the pocket seam when the first end of the pocket is in a closed position.

7. The article of apparel of claim 6, wherein the first end of the pocket is aligned with the uppermost edge of the pouch panel.

8. The article of apparel of claim 6, wherein the first side of the first end of the pocket is substantially aligned with the uppermost edge of the pouch panel in the closed position.

9. The article of apparel of claim 6, wherein the body of the pocket is flat in the closed position.

10. The article of apparel of claim 1, wherein the second side of the first end of the pocket is substantially aligned with the uppermost edge of the pouch panel.

11. The article of apparel of claim 1, wherein the first end of the pocket is adapted to receive a beverage container.

12. The article of apparel of claim 11, wherein the second end of the pocket is adapted to support the beverage container.

13. The article of apparel of claim 1, wherein the closed end comprises a gap.

14. The article of apparel of claim 1, wherein the pocket is collapsible.

15. The article of apparel of claim 1, wherein the body comprises a thermally-insulating material.

16. The article of apparel of claim 1 further comprising:

a back panel opposite the front panel; and a hood attached to the front and back panels.

17. The article of apparel of claim 16, wherein a loop is coupled with the hood.

18. The article of apparel of claim 17, wherein the hood is attached to the front and back panels by a hood seam and the loop is attached to the hood seam.

19. The article of apparel of claim 17, wherein the loop is adapted to retain earphones.

20. The article of apparel of claim 1, wherein an eyelet is disposed in the front panel behind the pouch panel.

21. An article of apparel having a vertical longitudinal axis that bisects the article of apparel into a left half portion and a right half portion, said article of apparel comprising:

a front panel;

a pouch defined by a pouch panel attached to an exterior surface of the front panel, wherein the pouch is closed along a bottom of the pouch and defines a first lateral opening and a second lateral opening opposite the first lateral opening so that an interior area of the pouch is accessible through both the first lateral opening and the second lateral opening to allow insertion of a wearer's hands, wherein the first lateral opening is located entirely within the left half portion and the second lateral opening is located entirely within the right half portion;

a pocket comprising an upper first end, a lower second end opposite the first end, and a body joining the first and second ends; and means for selectively opening and closing the first end of the pocket, wherein the pocket is disposed between the pouch panel and the front panel and wherein the first end of the pocket is attached to the pouch panel and the front panel, and wherein the body of the pocket is accessible from both the first and second lateral openings.

22. The article of apparel of claim 21, wherein the first end of the pocket is aligned with an uppermost edge of the pouch panel.

23. The article of apparel of claim 21, wherein the first end of the pocket comprises a first side and a second side opposite the first side.

24. The article of apparel of claim 23, wherein the means for selectively opening and closeing is attached to the first and second sides of the first end of the pocket.

25. The article of apparel of claim 24, wherein the means for selectively opening and closing comprises a hook and loop fastener.

26. The article of apparel of claim 23, wherein the first side of the first end of the pocket is attached to the front panel and the second side of the first end of the pocket is attached to the pouch panel.

27. The article of apparel of claim 21, wherein the second end is substantially closed.

28. The article of apparel of claim 21, wherein an interior surface of the pouch and an exterior surface of the front panel define said interior area of the pouch.

29. The article of apparel of claim 28, wherein the body of the pocket is disposed within the interior area of the pouch.

* * * * *